US012439978B2

(12) United States Patent
She et al.

(10) Patent No.: US 12,439,978 B2
(45) Date of Patent: Oct. 14, 2025

(54) POSTURE-CORRECTING UNDERWEAR WITH GOOD SUPPORTING AND INVISIBILITY EFFECTS

(71) Applicant: Guangzhou Xingyi Network Technology Co., Ltd., Guangzhou (CN)

(72) Inventors: Xiwei She, Guangzhou (CN); Jingyi Zhong, Guangzhou (CN)

(73) Assignee: Guangzhou Xingyi Network Technology Co., Ltd., Guangzhou (CN)

( * ) Notice: Subject to any disclaimer, the term of this patent is extended or adjusted under 35 U.S.C. 154(b) by 0 days.

(21) Appl. No.: 19/031,207

(22) Filed: Jan. 17, 2025

(65) Prior Publication Data

US 2025/0160446 A1 May 22, 2025

(30) Foreign Application Priority Data

Aug. 27, 2024 (CN) ..... 202422095503.3

(51) Int. Cl.
*A41C 3/00* (2006.01)

(52) U.S. Cl.
CPC ..... *A41C 3/005* (2013.01); *A41C 3/0071* (2013.01)

(58) Field of Classification Search
CPC ..... A41C 3/0071; A41C 3/005
See application file for complete search history.

(56) References Cited

U.S. PATENT DOCUMENTS

| | | | | |
|---|---|---|---|---|
| 6,280,287 | B1 * | 8/2001 | Keith | A41F 15/002 450/41 |
| 8,167,679 | B2 * | 5/2012 | Seraceno | A41C 3/02 450/86 |
| 10,321,723 | B2 * | 6/2019 | Kelley | A41C 3/0057 |
| 10,342,269 | B1 * | 7/2019 | Rutkoski | A41C 3/0057 |
| 12,059,041 | B1 * | 8/2024 | Saraceno | A41C 3/0057 |
| 2006/0089083 | A1 | 4/2006 | Tonser | |
| 2009/0233522 | A1 * | 9/2009 | Schlatmann | A41C 3/00 450/58 |

(Continued)

OTHER PUBLICATIONS

Guangzhou Xingyi Network Technology Co., Ltd. 'A kind of high-performance'; search report dated Oct. 24, 2024, pp. 1-8, machine translation dated Jan. 12, 2025.

(Continued)

*Primary Examiner* — Gloria M Hale

(57) ABSTRACT

A posture-correcting underwear with good supporting and invisibility effects comprises a bra body comprising a front panel and a back panel, wherein the shoulder position of the front panel is connected with the shoulder position of the back panel to form a shoulder strap, and the side edge of the front panel is connected with the side edge of the back panel to form a side wing; each shoulder strap is respectively provided with a posture-correcting strap; one end of each posture-correcting strap is connected with the shoulder strap, and the other end of each posture-correcting strap is movably extended towards the back panel; the posture-correcting straps extend from the shoulder position of the bra body towards the back, and pass through the back and turn back to the front panel from the armpit, and then pass through the side wing, and are connected in front of the under bust.

10 Claims, 5 Drawing Sheets

(56) References Cited

U.S. PATENT DOCUMENTS

| | | | | |
|---|---|---|---|---|
| 2010/0190411 | A1* | 7/2010 | Saraceno | A41C 3/02 450/86 |
| 2011/0117818 | A1* | 5/2011 | Barnard | A41C 3/02 450/58 |

OTHER PUBLICATIONS

Chinese patent publication 220236081U; Application No. CN202321636607.X, dated Dec. 26, 2023, Machine translation generated Jan. 12, 2025, pp. 1-11.

* cited by examiner

POSTURE-CORRECTING UNDERWEAR WITH GOOD SUPPORTING AND INVISIBILITY EFFECTS

CROSS-REFERENCE TO RELATED APPLICATIONS

The present application claims priority to Chinese Patent Application No. 2024220955033, filed on Aug. 27, 2024, the content of which is incorporated herein by reference in its entirety.

TECHNICAL FIELD

The present utility model belongs to the technical field of underwear, in particular to a posture-correcting underwear with good supporting and invisibility effects.

BACKGROUND

With the continuous improvement of living standards, people pay more and more attention to their physical health and physical beauty. Bad posture, such as hunchback, hunchback, etc., will affect the overall image of the individual, making people appear lack of self-confidence and elegance; moreover, if these unhealthy postures are not corrected for a long time, they may also lead to spinal health problems. At the same time, considering that the human chest is mainly composed of adipose tissue and mammary glands, it lacks sufficient muscle support, therefore underwear with posture correction and chest support function is needed to improve posture problems.

The existing underwear generally has the function of supporting the chest. For example, in the prior art, the CN Patent No. CN204949542U discloses a health underwear without rims. In this prior art, the cups are integrally molded cups, which can have the effect of high-quality rims even without rims, and have a gathering effect, which can make the body beautiful. However, although the integrally formed mold cup can support the chest, the density of the mold cup of this underwear is high, which leads to poor ventilation effect. Moreover, the above-mentioned prior art cannot improve the wearer's bad posture such as hunchback and hunchback.

In order to help improve the posture and protect the spine, there are some products on the market, but these products are external products. If the wearer uses them close to the skin, the following problems will occur: firstly, there are obvious sewing lines at the seams of the existing products with good back, which will rub against the skin during wearing, which will easily lead to skin redness, allergies and other phenomena, which will bring discomfort to consumers; Secondly, the fabric of the existing back-good products is thick, although it has certain supporting force, but it may have the problem of air tightness. Wearing it for a long time will easily lead to skin sweating, which will lead to the growth of skin germs and have adverse effects on the health of the wearer.

Therefore, there is an urgent need for a kind of underwear with comfortable, breathable, good supporting and invisibility effects.

SUMMARY

In view of the problems in the related technology, the present utility model puts forward a posture-correcting underwear with good supporting and invisibility effects, so as to overcome the above technical problems in the existing related technology. By designing posture-correcting straps which are respectively connected with shoulder straps, and making them extend in a specific path and cross at the back, an effective chest lift is formed, so that the present utility model can improve the bad posture of the wearer and enhance the aesthetic feeling of the wearer.

The technical solution of the present utility model is realized as follows: a posture-correcting underwear with good supporting and invisibility effects, comprising a bra body, wherein the bra body includes a front panel and a back panel, a shoulder position of the front panel is connected with a shoulder position of the back panel to form a shoulder strap, and a side edge of the front panel is connected with a side edge of the back panel to form a side wing;

the front panel is provided with two detachable cups, and the two cups are symmetrically disposed left and right; the front panel is provided with an under bust just below the two cups, and both ends of the under bust are respectively connected with the side wings on the left and right sides;

each shoulder strap is respectively provided with a posture-correcting strap; one end of each posture-correcting strap is connected with the shoulder strap, and the other end of each posture-correcting strap is movably extended towards the back panel; the posture-correcting straps on that left and right sides start to extend from the shoulder position of the bra body towards a back part, pass through the back part from an underarm and turn back toward the front panel, then pass through the side wing, and are connected in front of the under bust through an adjustable connecting structure to form a chest support, so that the shoulders of a wearer are stretched backwards through the traction of the posture-correcting straps; the two posture-correcting straps located on the back are disposed in a crossed way, wherein one posture-correcting strap is detachably connected to the other posture-correcting strap.

Further, each posture-correcting strap includes a back strap and an extension strap; one end of the back strap is connected with the shoulder strap, and the other end extends to be connected with the extension strap, wherein the extension strap of one posture-correcting strap is connected with the extension strap of the other posture-correcting strap through the adjustable connecting structure.

Further, one end of the back strap connected with the shoulder strap is a fixed end, and a bottom surface of the fixed end is completely attached to the shoulder strap.

Further, the adjustable connecting structure includes a plurality of buckles disposed on one of the extension straps and at least one hook disposed on the other extension strap, and the buckles are matched and buckled with the hooks.

Still further, a plurality of rows of the buckles are disposed, and each row is provided with at least two buckles, so that the wearer can make adjustment according to his own body condition.

Further, one of the posture-correcting straps is provided with a slit for the other posture-correcting strap to pass through; and a diameter of the slit is larger than a width of the posture-correcting strap;

the shape of the slit is straight, or I-shaped, or other common opening shapes such as circle and square;

further, the slit is disposed on the shoulder strap.

Further, the front panel includes a face cloth and a lining cloth which are sequentially connected from outside to inside, and a cup cavity is retained between the face cloth and the lining cloth for accommodating the two cups;

still further, one side of the lining cloth is in direct contact with the chest skin of a human body;

the face cloth and the lining cloth are attached to each other by a glue dispensing process; the back panel includes a skin patch cloth and an outer layer cloth which are sequentially attached to each other from inside to outside; and the face cloth, the lining cloth, the skin patch cloth and the outer cloth are all integrally cut and formed;

it should be noted that the inner side of the joint between the shoulder position of the front panel and the shoulder position of the back panel is covered by a first baffle, and the inner side of the joint between the front panel and the back panel is covered by a second baffle; wherein, one surface of the first baffle and one surface of the second baffle are used for directly contacting with the skin of the human chest, so as to avoid friction between the joint and the skin of the human body.

Further, the lining cloth is provided with a socket that is communicated with the cup cavity; and the two cups are connected into a whole through a strap body.

Further, the front panel, the back panel and the posture-correcting strap are all made of breathable cloth; the back panel is further provided with a hollowed-out air vent, and when the bra body is worn, the air vent is located right below two shoulder blades of a human body.

Still further, the back panel and the posture correcting strap are both made of elastic breathable cloth with shape memory function; the air vent includes an upper edge and a lower edge which are connected with each other, wherein the shape of the upper edge is V-shaped, and the shape of the lower edge is arc;

it should be noted that the shape of the air vent can also be diamond, oval or other irregular shapes, and the shape of the air vent is not limited by the present utility model.

Further, the front panel further includes a pulling structure disposed below the two cups; and the pulling structure extends from a lower edge of one cup to a lower edge of the other cup to form a W-shaped pulling strap.

Further, the front panel includes a V-shaped front collar, and a lowest position of the V-shaped front collar is disposed between the two cups.

The present utility model has the following beneficial effects:

(1) In this utility model, the posture-correcting straps connected with each shoulder strap are designed, and they extend and cross at the back in a specific path (starting from the shoulder position, passing through the back and turning back to the front of the under bust) to form an effective chest lift. This design not only strengthens the supporting force of the posture-correcting underwear to the chest, but also makes the wearer's shoulders stretch backwards through the traction of the posture-correcting strap, so as to achieve the effect similar to the chest-expanding movement and realize the natural straight posture, thereby improving the wearer's bad posture and enhancing the wearer's posture aesthetic feeling;

(2) the two posture-correcting straps located on the back are disposed in a cross way, so that the two posture-correcting straps can relieve the shoulder and neck pain caused by long-term bow-down or poor sitting posture by supporting and pulling the shoulders, which is particularly effective for people who need to keep a fixed posture for a long time; at the same time, the cross setting can disperse the pressure to a wider area, reduce the concentrated pressure on a single part, reduce the discomfort caused by long-term wearing through the comprehensive effect on the shoulders, back and chest, and help the wearer adjust and improve the posture;

(3) one end of each posture-correcting strap is fixedly connected with the shoulder strap, and the other end adopts the movable extension design, so that the posture-correcting strap can be finely adjusted according to the body shape and comfort requirements of different wearers, and the fit and comfort of the posture correcting underwear are ensured.

REFERENCE SIGNS

1. Front panel; 11. Face cloth; 12. Lining cloth; 121. Socket; 13. Cup cavity; 14. V-shaped front collar; 15. Side wing; 16. Under bust; 2, Back panel; 21, Skin patch cloth; 22. Outer cloth; 23. Air vent; 3. Shoulder strap; 4. Cup; 5, First baffle; 6, Posture-correcting strap; 61. Shoulder strap; 611, Fixed end; 612, Slit; 62. Extension strap; 7, Buckle; 8. Pulling strap.

DESCRIPTION OF EMBODIMENTS

The technical solution in the embodiment of the present utility model will be clearly and completely described below with reference to the drawings. Obviously, the described embodiment is only part of, rather than all of the embodiments of the present utility model. Based on the embodiments in this utility model, all other embodiments obtained by those skilled in the art without creative work belong to the protection scope of this utility model.

In the description of the present utility model, it should be understood that the terms "center", "longitudinal", "transverse", "length", "width", "thickness", "upper", "lower", "front", "rear", "left", "right", "vertical" and "horizontal", "top", "bottom", "inside", "outside", "clockwise", "counter-clockwise" and the like indicate orientation or positional relationships based on those shown in the accompanying drawings, only for the convenience of describing the present utility model and simplifying the description, and does not indicate or imply that the equipment or elements must have a specific orientation, be constructed and operated in a specific orientation, therefore they cannot be construed as a limitation of the present utility model.

Figure 1:
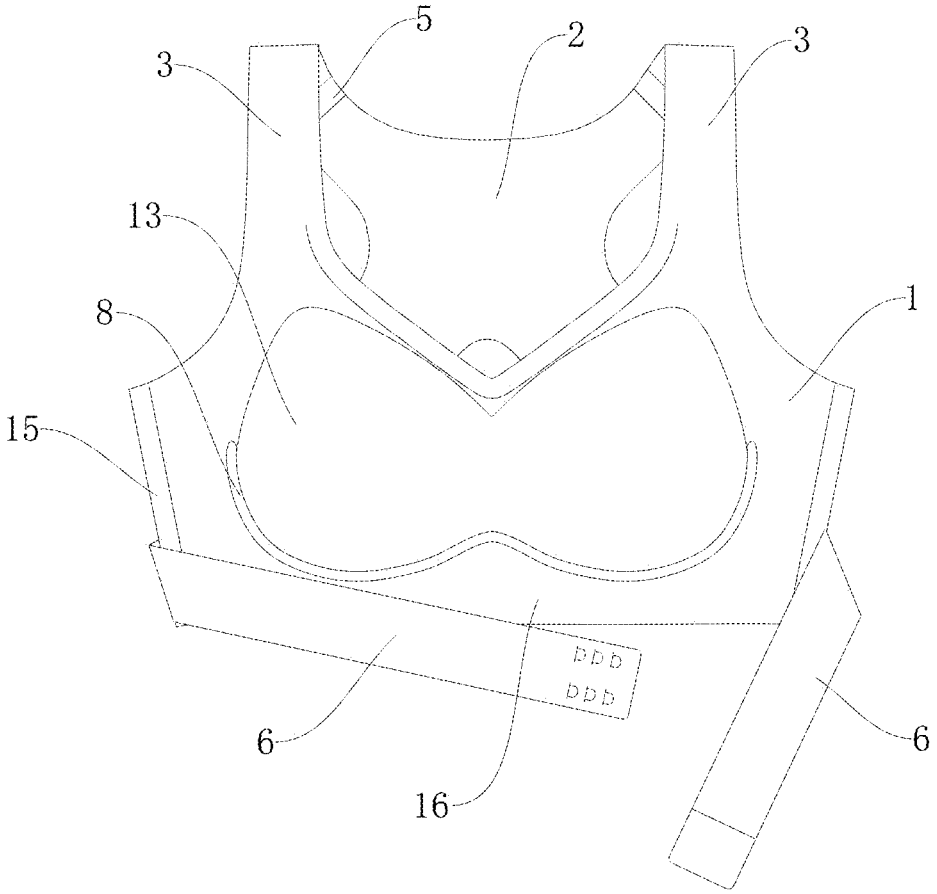
FIG. 1 is a schematic structural diagram of a posture-correcting underwear with good supporting and invisibility effects of the present utility model.
Figure 2:
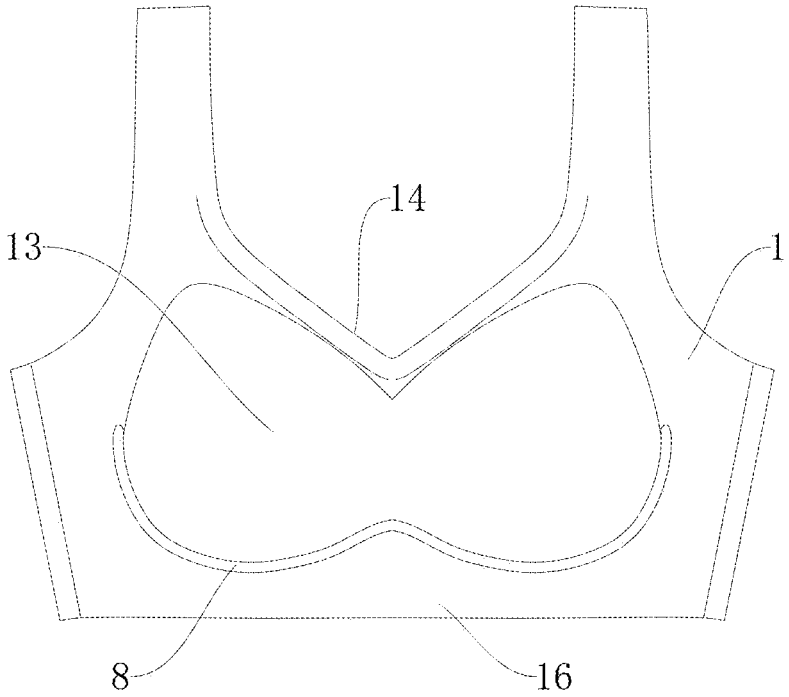
FIG. 2 is a schematic structural diagram of the front panel of the present utility model.
Figure 3:
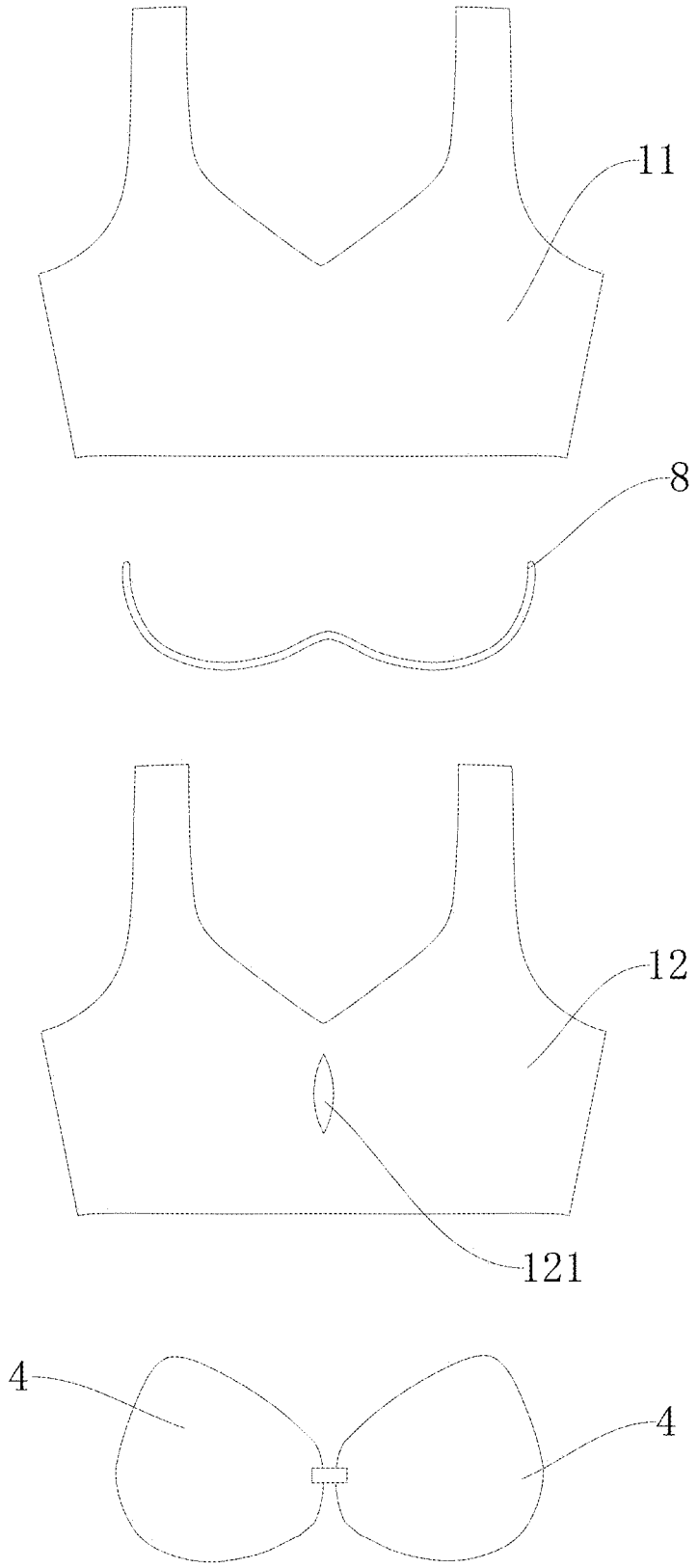
FIG. 3 is an exploded schematic view of the front panel of the present utility model.
Figure 4:
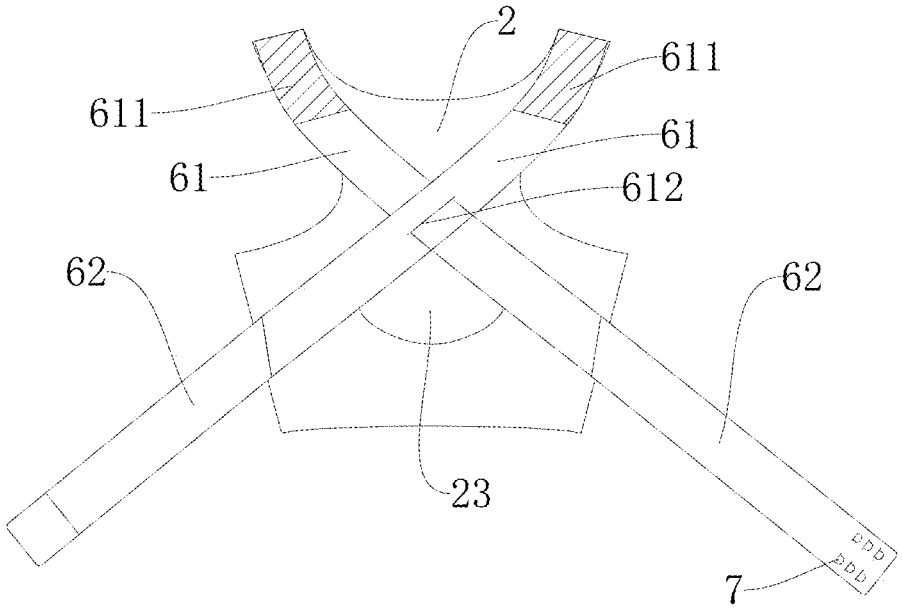
FIG. 4 is a structural schematic diagram of the back panel of the present utility model.
Figure 5:
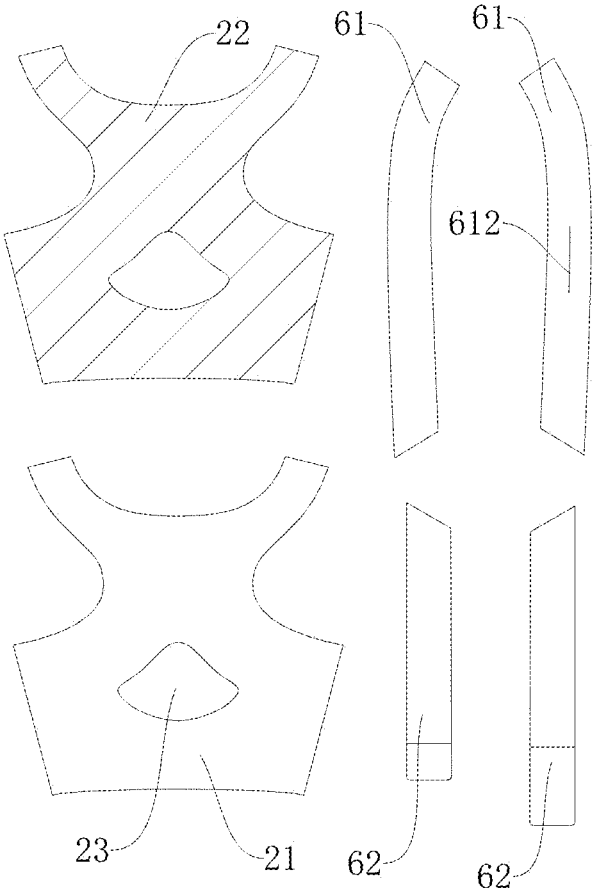
FIG. 5 is a schematic diagram of the structural decomposition of the back panel of the present utility model.

As shown in FIG. 1-5, a posture-correcting underwear with good supporting and invisibility effects includes a bra body, which includes a front panel 1 and a back panel 2, wherein shoulder positions of the front panel 1 and the back panel 2 are connected to form a shoulder strap 3, and side edges of the front panel 1 and the back panel 2 are connected to form a side wing of 15;

the front panel 1 is provided with two detachable cups 4, and the two cups 4 are symmetrically disposed left and right; the front panel 1 is provided with an under bust 16 directly below the two cups 4, and both ends of the under bust 16 are respectively connected with the side wings 15 on the left and right sides;

it should be noted that the shoulder strap 3 in this embodiment is formed by connecting the front panel 1 and the back panel 2, which fits the shoulders of the human body to a greater extent; unlike some existing technologies, a thin rope strap is designed separately, and then the front and back panels are connected by buttons, which will leave an impression on the shoulders of the human body.

Specifically, the inner side of the joint between the shoulder position of the front panel 1 and the shoulder position of the back panel 2 is covered by a first baffle 5, and the inner side of the joint between the front panel 1 and the back panel 2 is covered by a second baffle 5; wherein, one surface of the first baffle 5 and one surface of the second baffle are used for direct contact with human chest skin to avoid friction between the joint and human skin; in this embodiment, by arranging the first baffle 5 and the second baffle, the joint between the shoulder position and the side wing 15 is more invisible and seamless.

Each shoulder strap 3 is respectively provided with a posture-correcting strap 6; one end of each posture-correcting strap 6 is connected with the shoulder strap 3, and the other end of each posture-correcting strap 6 is movably extended toward the back panel 2; the posture-correcting straps 6 on the left and right sides extend from the shoulder position of the bra body towards the back, pass through the back from the armpit and turn back to the front panel 1, and then pass through the side wing 15, and are connected in front of the under bust 16 through a adjustable connecting structure to form a chest support; the two posture-correcting straps 6 on the back are disposed in a crossed way, wherein one posture-correcting strap 6 is detachably connected to the other posture-correcting strap 6.

First of all, in this embodiment, the posture-correcting straps 6 connected with each shoulder strap 3 are designed, and they extend and cross at the back in a specific path (starting from the shoulder position to the front panel 1 through the back, and then connected to the front of the under bust 16 through the side wing 15), thus forming an effective chest lift. This design not only strengthens the supporting force of the posture-correcting underwear to the chest, but also makes the wearer's shoulders stretch backwards through the traction of the posture-correcting strap 6, so as to achieve the effect similar to the chest-expanding movement and realize the natural straight posture, thereby improving the wearer's bad posture and enhancing the wearer's posture aesthetic feeling.

Secondly, the two posture-correcting straps 6 located on the back are disposed in a cross way, so that the two posture-correcting straps 6 can relieve the shoulder and neck pain caused by long-term bow or poor sitting posture by supporting and pulling the shoulders, which is particularly effective for people who need to keep a fixed posture for a long time; at the same time, the cross setting can disperse the pressure to a wider area, reduce the concentrated pressure on a single part, reduce the discomfort caused by long-term wearing through the comprehensive effect on the shoulders, back and chest, and help the wearer adjust and improve the posture.

Moreover, one end of each posture-correcting strap 6 is fixedly connected with the shoulder strap 3, and the other end is designed to be movably extended. This flexibility enables the posture-correcting straps 6 to be finely adjusted according to the body shape and comfort requirements of different wearers, thus ensuring the fit and comfort of the posture correcting underwear.

Specifically, each posture-correcting strap 6 includes a back strap 61 and an extension strap 62; one end of the shoulder strap 61 is connected with the shoulder strap 3, and the other end is extended to be connected with the extension strap 62. One of the extension straps 62 of the posture-correcting strap 6 is connected with another extension strap 62 of the posture-correcting strap 6 through the adjustable connecting structure;

The width of the posture-correcting strap 6 does not exceed the width of the shoulder strap 3. In this embodiment, it is preferable that the width of the posture-correcting strap 6 is equal to the width of the shoulder strap 3, so that the supporting force of the posture-correcting strap 6 on the wearer's back can be ensured, and the area covered by the posture-correcting strap 6 on the bra body can be reduced, so that the whole posture correcting underwear is lighter and more breathable.

Specifically, one end of the shoulder strap 61 connected to the shoulder strap 3 is a fixed end 611, and the bottom surface of the fixed end 611 is completely attached to the shoulder strap 3 in the form of surface contact by gluing or sewing, so that the fixed end 611 can be firmly attached to the shoulder strap 3, and the connection between the two is more stable, so as to prevent the wearer from forcibly pulling the posture-correcting strap 6 during wearing, which otherwise will lead to the separation of the fixed end 611 from the shoulder strap 3, thereby prolonging the use of this embodiment.

Specifically, the adjustable connecting structure includes a plurality of buckles 7 disposed on one of the extension straps 62 and at least one hook disposed on the other extension strap 62, and the buckles 7 are matched and buckled with the hooks. In this embodiment, the buckle 7 is matched with the hook, so that the wearer can buckle easily on the front side of the underwear, which avoids the trouble of traditional underwear buckling on the back, saving time and labor.

More specifically, a plurality of rows of the buckles 7 are disposed, and each row is provided with at least two buckles 7, so that the wearer can adjust according to his own body condition, thereby improving the wearing comfort of the embodiment and expanding the application range of the embodiment. After the two extension straps 62 are buckled, they can also form a chest support, providing uniform support for the human chest, so as to effectively solve the problem of sagging or fat in the chest caused by incorrect wearing methods.

It should be noted that the adjustable connecting structure between the two extension straps 62 can also adopt other connection methods such as hook and loop bonding and rope binding, but the fastening method adopted in this embodiment is more firm and convenient, and will not affect the elasticity of the bottom wall 16

Specifically, one of the posture-correcting straps 6 is provided with a slit 612 for the other posture-correcting strap 6 to pass through, so as to realize the detachable cross design. The diameter of the slit 612 is larger than the width of the posture-correcting strap 6. The shape of the slit 612 is a straight, or I-shaped, or other common opening shapes such as circle and square Specifically, the slit 612 is disposed on the shoulder strap 61.

The design of the slit 612 not only enables the other posture-correcting strap 6 to smoothly pass through, but also restricts the two posture-correcting straps 6 from always being in the cross state, so that the wearer does not need to make efforts to adjust the two posture-correcting straps 6 to be in the cross state during wearing, thus realizing rapid wearing and improving convenience.

Specifically, the front panel 1 includes a face cloth 11 and a lining cloth 12 which are connected in sequence from outside to inside, and a cup cavity 13 is retained between the face cloth 11 and the lining cloth 12 for accommodating two cups 4; more specifically, one side of the lining cloth 12 is in direct contact with the skin of the human chest.

The face cloth 11 and the lining cloth 12 are attached and connected by a dispensing process; The back panel 2 includes a skin-sticking cloth 21 and an outer cloth 22 which are sequentially attached from the inside to the outside; The face cloth 11, the lining cloth 12, the skin patch cloth 21 and the outer cloth 22 are all integrally cut and formed;

By adopting the integrated cutting molding and glue dispensing process, the posture-correcting underwear described in this embodiment has no obvious sewing lines or other stitching marks, and is even more traceless, thus providing a more personal and comfortable wearing experience for the wearer.

Specifically, the lining cloth 12 is provided with a socket 121, and the socket 121 communicates with the cup cavity 13; the two cups 4 are connected into a whole through a strap body.

The socket 121 is used for inserting the cup 4 into the cup cavity 13, and the connection between the cup 4 and the cup cavity 13 is detachable, so that even if the cup 4 is damaged, the user can replace it by himself, with high convenience; after the two cups 4 are connected into a whole, the two cups 4 will restrict each other, which is beneficial to prevent the cups 4 from turning over in the cleaning process.

Specifically, the front panel 1, the back panel 2 and the posture-correcting strap 6 are all made of breathable cloth; the back panel 2 is further provided with a hollowed-out air vent 23, and when the bra body is worn, the air vent 23 is located right below two shoulder blades of a human body.

It should be noted that, due to the elasticity of the fabric used in the back panel 2, when wearing this embodiment, compared with the two straps 61 which are crossed above the air vent 23, the air vent 23 will be stretched and enlarged, so that the muscles under the two shoulder blades of the human body are more relaxed, achieving the effect of tightening up and loosening down, realizing comfortable posture correction, and further increasing the air permeability of the back panel 2.

More specifically, the back panel 2 and the posture-correcting strap 6 are both made of elastic breathable cloth with a shape memory function; the air vent 23 includes an upper edge and a lower edge which are connected with each other, wherein the upper edge is V-shaped and the lower edge is arc-shaped.

It should be noted that the shape of the air vent 23 can also be rhombic, elliptical or other irregular shapes, and the shape of the air vent 23 is not limited in this embodiment.

In this embodiment, the elastic breathable fabric with a shape memory function is adopted, so that the posture-correcting strap 6 can provide memory support during wearing, effectively improving bad postures such as hunchback and hunchback, and helping the wearer to maintain a correct sitting posture and standing posture.

Specifically, the front panel 1 further includes a pulling structure disposed below the two cups 4. The pulling structure extends from the lower edge of one cup 4 to the lower edge of the other cup 4 to form a W-shaped pulling strap 8; the design of the W-shaped lifting strap 8 is conducive to further improving the supporting force of the front panel 1 on the human chest and avoiding the sagging of the human chest.

Specifically, the front panel 1 includes a V-shaped front collar 14, and the lowest position of the V-shaped front collar 14 is disposed between two cups 4; compared with the prior art, the V-shaped front collar 14 described in this embodiment can reduce the pressure on the human chest and nearby parts, and further enhance the comfort of the present utility model.

According to the disclosure and teaching of the above specification, the technical personnel in the field to which the present utility model belongs can also change and modify the above embodiment. Therefore, the present utility model is not limited to the specific embodiments disclosed and described above, and some modifications and changes to the present utility model should also fall within the protection scope of the claims of the present utility model. In addition, although some specific terms are used in this specification, these terms are only for convenience of explanation and do not constitute any restrictions on the present utility model.

What is claimed is:

1. A posture-correcting underwear comprising a bra body, wherein the bra body comprises a front panel and a back panel, wherein a shoulder portion of the front panel is connected with a shoulder position of the back panel to form a shoulder strap, and a side edge of the front panel is connected with a side edge of the back panel to form a side wing; wherein the front panel is provided with two detachable cups, and the two cups are symmetrically disposed left and right; the front panel is provided with an under bust just below the two cups, and both ends of the under bust are respectively connected with the side wings on the left and right sides;

each shoulder strap is respectively provided with a posture-correcting strap; one end of each posture-correcting strap is connected with the shoulder strap, and a second end of each posture-correcting strap is movably extended towards the back panel; the posture-correcting straps on that left and right sides start to extend from the shoulder position of the bra body towards a back part, pass through the back part from an underarm and turn back toward the front panel, then pass through the side wing, and are connected in front of the under bust through an adjustable connecting structure to form a chest support, so that the shoulders of a wearer are stretched backwards through the traction of the posture-correcting straps; the two posture-correcting straps located on the back are disposed in a crossed way, wherein one posture-correcting strap is detachably connected to the other posture-correcting strap.

2. The posture-correcting underwear according to claim 1, wherein each posture-correcting strap comprises a back strap and an extension strap; one end of the back strap is connected with the shoulder strap, and the other end extends to be connected with the extension strap, wherein the extension strap of one posture-correcting strap is connected with the extension strap of the other posture-correcting strap by the adjustable connecting structure.

3. The posture-correcting underwear according to claim 2, wherein one end of the back strap connected with the shoulder strap is a fixed end, and a bottom surface of the fixed end is completely attached to the shoulder strap;

the adjustable connecting structure comprises a plurality of buckles disposed on one of the extension straps and at least one hook disposed on the other extension strap, and the buckles are matched and buckled with the hooks.

4. The posture-correcting underwear according to claim 1, wherein one of the posture-correcting straps is provided with a slit for the other posture-correcting strap to pass through; and a diameter of the slit is larger than a width of the posture-correcting strap.

5. The posture-correcting underwear according to claim 1, wherein the front panel comprises a face cloth and a lining cloth which are sequentially connected from outside to inside, and a cup cavity is retained between the face cloth and the lining cloth for accommodating the two cups; and the face cloth and the lining cloth are attached to each other by a glue dispensing process; the back panel comprises a skin patch cloth and an outer layer cloth which are sequentially attached to each other from inside to outside; and the face cloth, the lining cloth, the skin patch cloth and the outer cloth are all integrally cut and formed.

6. The posture-correcting underwear according to claim 5, wherein the lining cloth is provided with a socket that is communicated with a cup cavity; and the two cups integrated with the bra body.

7. The posture-correcting underwear according to claim 1, wherein the front panel, the back panel and the posture-correcting strap are all made of breathable cloth; the back panel is further provided with a hollowed-out air vent, and when the bra body is worn, the air vent is configured to be located right below two shoulder blades of a human body.

8. The posture-correcting underwear according to claim 7, wherein both the back panel and the posture-correcting strap are made of elastic breathable cloth.

9. The posture-correcting underwear according to claim 1, wherein the front panel further comprises a lifting structure disposed below the two cups; and the lifting structure extends from a lower edge of one cup to a lower edge of the other cup to form a W-shaped lifting strap.

10. The posture-correcting underwear according to claim 1, wherein the front panel comprises a V-shaped neckline, and a lowest position of the V-shaped neckline is disposed between the two cups.

* * * * *